US007104731B2

(12) United States Patent
Mohr

(10) Patent No.: US 7,104,731 B2
(45) Date of Patent: Sep. 12, 2006

(54) DIVISIBLE PILE SLEEVE

(75) Inventor: Rainer Mohr, Rönnau (DE)

(73) Assignee: MENCK GmbH, Kaltenkirchen (DE)

( * ) Notice: Subject to any disclaimer, the term of this patent is extended or adjusted under 35 U.S.C. 154(b) by 0 days.

(21) Appl. No.: 10/724,522

(22) Filed: Nov. 28, 2003

(65) Prior Publication Data

US 2004/0146364 A1 Jul. 29, 2004

(30) Foreign Application Priority Data

Nov. 28, 2002 (DE) ..... 102 55 753

(51) Int. Cl.
*E02D 7/02* (2006.01)

(52) U.S. Cl. ..... 405/232; 173/32; 173/128

(58) Field of Classification Search ..... 405/232; 173/1, 31–33, 90, 128, 129, 132
See application file for complete search history.

(56) References Cited

U.S. PATENT DOCUMENTS 4,362,216 A 12/1982 Jansz ..... 173/131
5,110,237 A * 5/1992 Hesse ..... 405/184
5,117,924 A * 6/1992 Bermingham ..... 173/210
6,202,757 B1 * 3/2001 Dahlberg ..... 173/1
6,368,023 B1 * 4/2002 Lau ..... 405/232
6,386,295 B1 * 5/2002 Suver ..... 173/1

FOREIGN PATENT DOCUMENTS

| | | |
|---|---|---|
| DE | 1 784 396 | 7/1971 |
| EP | 0 857 830 A1 | 8/1998 |
| EP | 09 84 105 | 3/2000 |

* cited by examiner

*Primary Examiner*—Meredith C. Petravick
*Assistant Examiner*—Tara L. Mayo
(74) *Attorney, Agent, or Firm*—Burr & Brown

(57) ABSTRACT

A pile driving device for driving in piles, with an axially-guided impact body movable in a hammer housing, an impact hood and a pile sleeve. So that the pile driving device can be transported by land without requiring surveys and preparation, the pile sleeve comprises two or more parts, with the pile sleeve being divided into radial or circular concentric partitions.

15 Claims, 7 Drawing Sheets

6

DIVISIBLE PILE SLEEVE

CROSS REFERENCE TO RELATED APPLICATION

This application claims the benefit of German Application DE 102 55 753.5, filed Nov. 28, 2002, the entirety of which is incorporated herein by reference.

FIELD OF THE INVENTION

The invention relates to a pile driving device for driving in piles, with an axially-guided impact body movable in a hammer housing, an impact hood and a pile sleeve.

The invention further relates to a method for assembling a pile driving device for driving in piles, the device comprising an impact body axially movable in a hammer housing, a foot, where applicable with an adapter ring, an impact hood and a pile sleeve.

BACKGROUND OF THE INVENTION

Pile driving devices of this kind are known from Patent Specifications DE 27 48 668 and DE 36 34 905 and have proved excellent for pile driving work on land and under water for the purpose of fixing structural bodies.

Such pile driving devices are designed for piles having a diameter of less than two and half meters and are no wider than this diameter. However, for other structures, such as, for example, wind generators, there is now an increasing need for pile driving devices which are suitable for driving in piles of a much larger diameter. These pile driving devices must have a point where they are set on the pile where they are of the same size greater than the pile to be driven. Special particularly wide pile driving devices are thereby required which are expensive to manufacture. Furthermore, a general rule of thumb applies where the pile sleeve should have a length which corresponds to at least twice the diameter of the pile which is to be driven in. This is necessary for securely guiding the pile sleeve in order to prevent tilting during operation. The structural length of the pile driving device thereby increases additionally because the pile sleeve has to be extended in proportion to the pile diameter in accordance with the above mentioned rule of thumb. Apart from the increased manufacturing costs a greater transport expense is also incurred. If pile driving devices are used in off-shore areas the pile driving devices can be conveyed for most of the journey length by ship. If however pile driving devices are used on land, such as when setting up wind generating plants, then the transport is often only, or for the most part, over land routes. Normal road transport of the load is only possible for widths of up to two and half meters. If the load is wider than this then the transport is only permissible on shut-off roads under special safety measures. Under such conditions extensive planning is required, possibly with structural measures on route being necessary. Conveyance by road is therefore time-consuming, complicated and expensive.

SUMMARY OF THE INVENTION

The object of the invention is therefore to provide a pile driving device and a method where the aforementioned drawbacks are avoided and the pile driving device can be manufactured cost-effectively. Furthermore it should be able to be transported over land without requiring any expensive special transport.

This is achieved according to the invention in that a distance is provided between the lower end of the pile sleeve and the impact hood which is less than twice the inner diameter, preferably less than half the inner diameter of the pile sleeve. Hitherto the rule applies that the pile sleeve is to have a length which corresponds to twice the diameter of the pile which is to be driven in, in order to prevent tilting. However it has surprisingly been shown that with pile diameters larger than two and half meters the pile sleeve can be considerably shorter. Thus, with a pile diameter of about four meters, according to the above rule of thumb actually a pile sleeve length of eight meters ought to be necessary but in actual fact only a length of below one meter is required. The reason for this is that with a pile having a diameter larger than two and half meters, during each impact the hammer always strikes close to the axis at the center of gravity of the pile. Surprisingly, the structural length of the pile sleeve can thereby be reduced which reduces the manufacturing costs and makes transport of the pile driving device easier.

The pile sleeve is designed to be divisible into two or more parts along at least one preferably radial and/or circular concentric partition line. The hammer housing of the conventional pile driving devices has as a rule a diameter of less than one and half meters. The pile driving devices widen out considerably at their lower end, particularly in the area of the pile sleeve where it is placed on the driving pile. There it is necessary to reach at least the diameter of the pile which is to be driven in. Through separating the pile sleeve this can be split into two parts which can be transported individually. Through this feature of the invention the width of the pile sleeve is halved. A further reduction in width is possible where necessary through additional partition lines so that conveyance of the pile driving device is possible without expensive special transport measures. If the pile sleeve can additionally be split up by means of circular concentric partition lines then assembly is easier since structural elements such as, for example, the impact hood can be inserted through the openings.

If the pile sleeve has a seal between the parts this can be made airtight. When used underwater air can be blown into the pile sleeve and water displaced, making use of the pile driving device possible in offshore areas.

Known pile driving devices are suitable for use with piles having a diameter of typically 2.5 meters or less. Whilst a device according to the present invention could also be used for a pile of such a diameter, it is likely that this would not be economic due to the additional manufacturing costs involved in producing a device according to the present invention.

The pile driving device of the present invention is likely to be of great use in driving piles having a diameter greater than 2.5 meters, such as the 5 meter diameter piles that are commonly used in offshore wind energy projects.

Presently it is believed that the maximum practical diameter for a pile is 8 meters and there is no reason why the pile driving device of the present invention could not be used with such a pile. The pile sleeve may have one or more adapter elements for adapting to piles of different diameter. The same pile sleeve can be used for different diameters, which lowers the cost.

The adapter elements are designed as radially disposed plates. Hereby, in a simple way the distance between the pile and sleeve is maintained. Through the radial arrangement of the adapter elements the stiffness and stability of the pile sleeve is increased.

In order to adapt the pile driving device to piles with different diameters, the impact hood has at its lower end an adapter plate whose diameter on the top side corresponds to the diameter of the impact hood and whose diameter on the lower side corresponds to the diameter of the pile which is to be driven in. Impact hoods can hereby be operated in a simple and cost-effective manner to accommodate piles across a wide range of pile diameter.

In that the pile guide is designed as a cone with fitted cylinder sleeve, the impact hood is covered by the cone whilst the cylinder jacket undertakes the actual guide of the pile. Operating the pile driving device under water is possible through the air and water tight design.

In order to be able to assemble rapidly the parts of the pile sleeve on site, flanges may be provided on the partition line. The pile sleeve can be assembled by the use of mechanical connecting elements, providing a rapid and reliable assembly of the pile sleeve.

If the pile sleeve is not used under water then it is not necessary for it to be air tight. In this case the cone and/or cylinder of the pile sleeve can be designed as a skeleton frame structure with interconnected supports. It is hereby particularly light which makes assembly and transport easier.

The hammer housing of the pile driving device has a hammer foot which contains shock absorbers for taking up the recoil. Between the hammer foot and pile sleeve is an adapter ring through which the pile sleeve can be fitted on the hammer foot.

After transport of the pile driving device the latter has to be assembled on site. For assembly the impact hood is first mounted on a mounting block. Then the parts of the pile sleeve are disposed to surround the mounting block and impact hood. The flanges of the pile sleeve can then be connected together, for example, by being screwed together.

The hammer foot, impact body and hammer housing may be supplied as a single structural group, preferably including the adapter ring. This structural group is connected fixedly to the impact hood during assembly. Accordingly, the assembly on site is restricted to fixing the pile sleeve on to the hammer foot and it is therefore particularly easy and quick to carry out.

If an impact hood is to be adapted to the diameter of a pile then the impact hood is first placed on an adapter plate located on the assembly block.

By connecting the parts of the pile sleeve in a water- and pressure-tight manner the pile driving device can be used also under water since it is possible to let air into the pile sleeve.

The invention will now be described by way of example with reference to a preferred embodiment illustrated in the drawings from which further advantageous details can be derived. Parts having the same function have the same reference numerals. In the drawings:

BRIEF DESCRIPTION OF THE DRAWING FIGURES

Figure 3A:
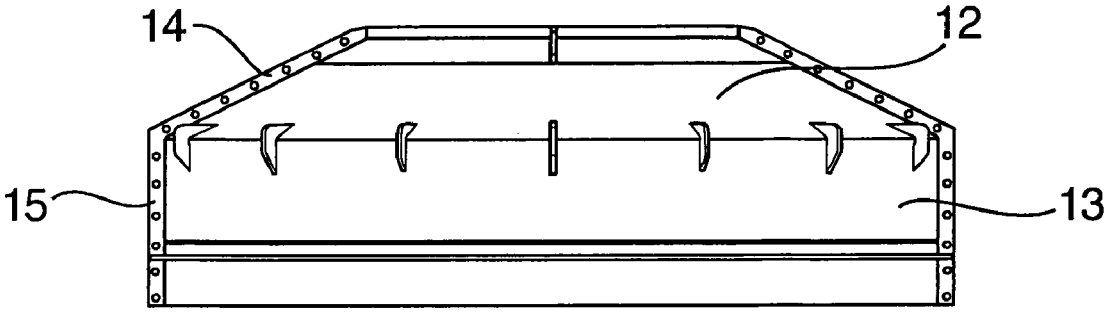
Figure 3B:
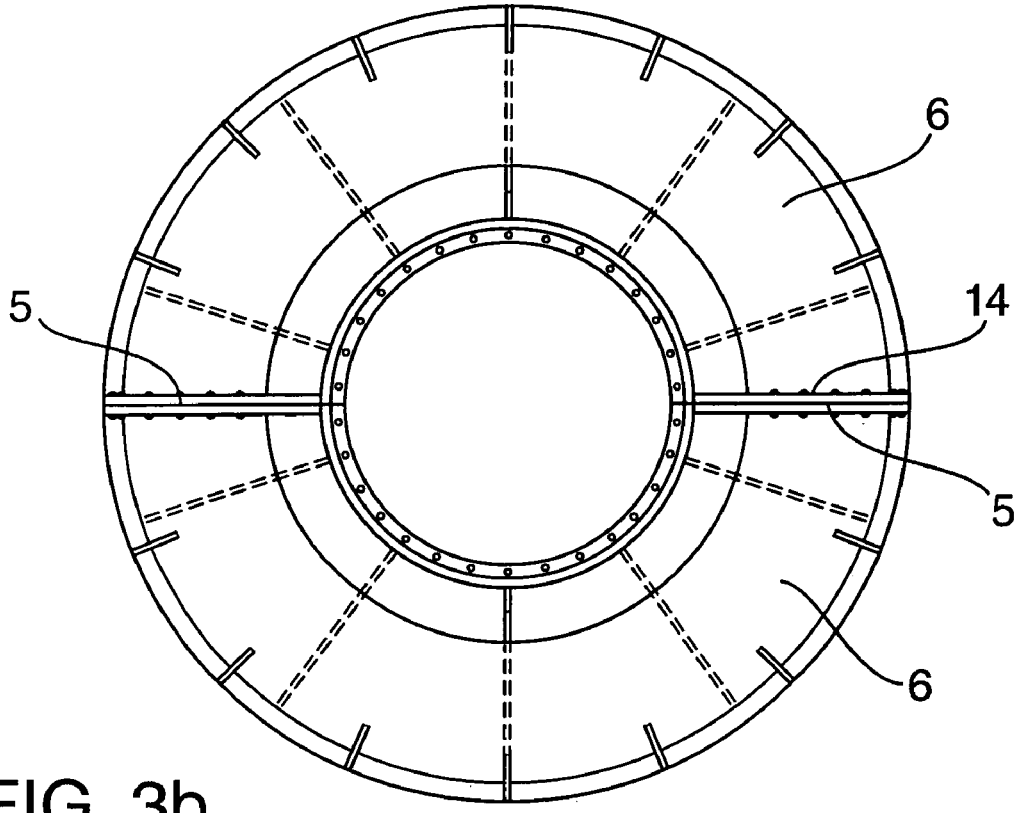
Figure 4:
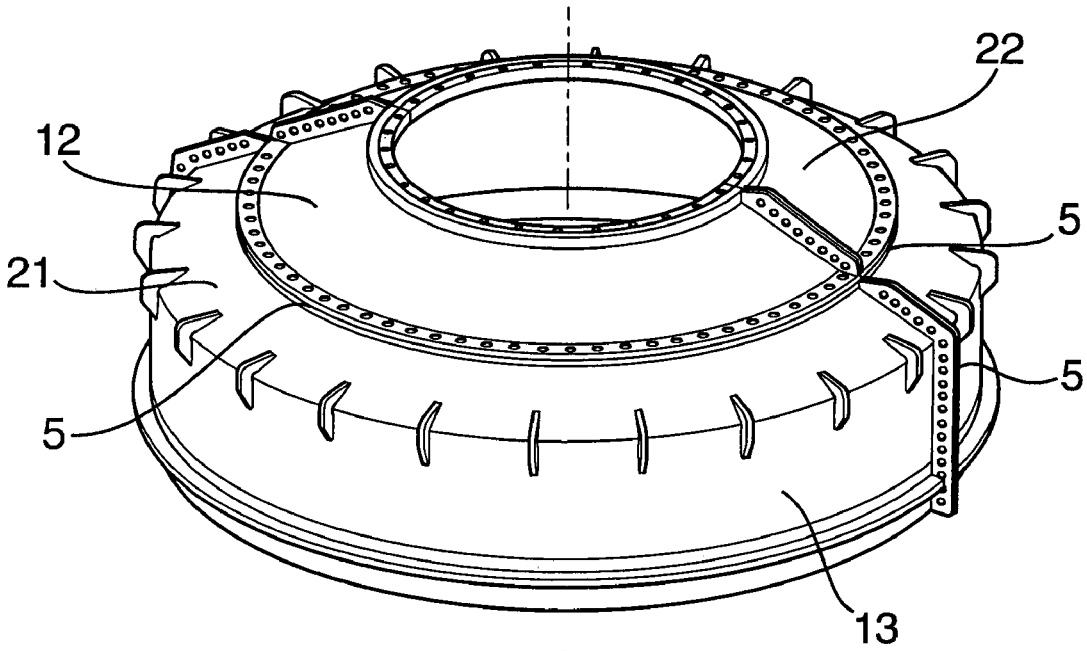
Figure 5:
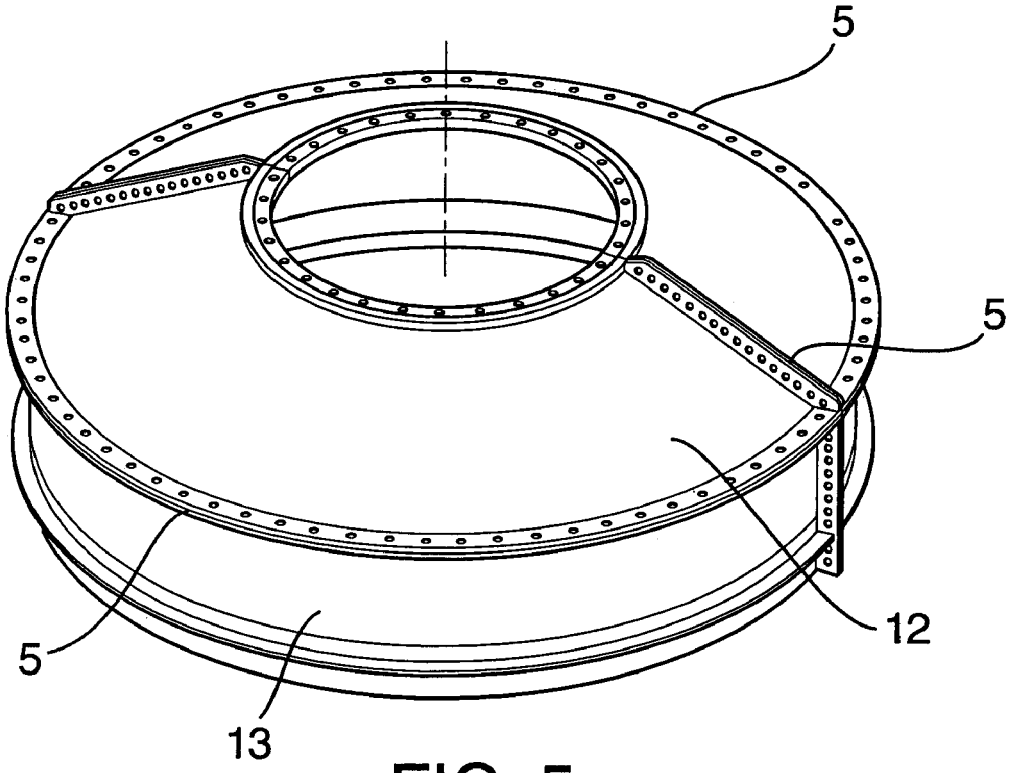
Figure 6:
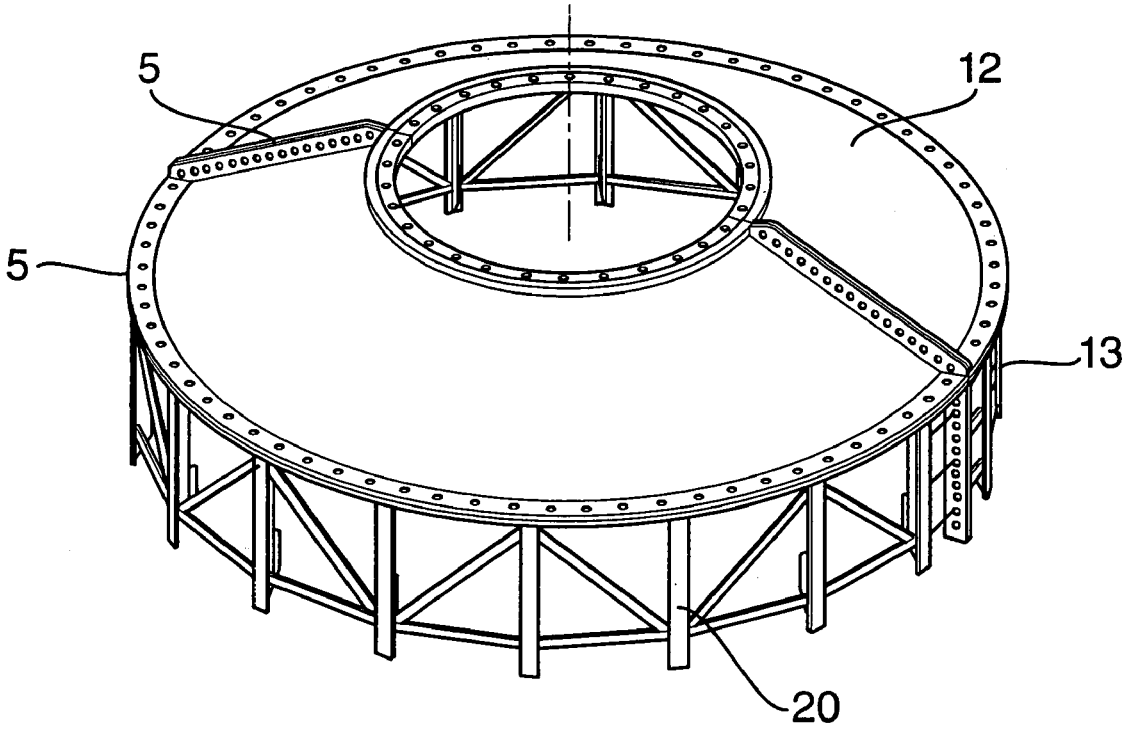
Figure 7:
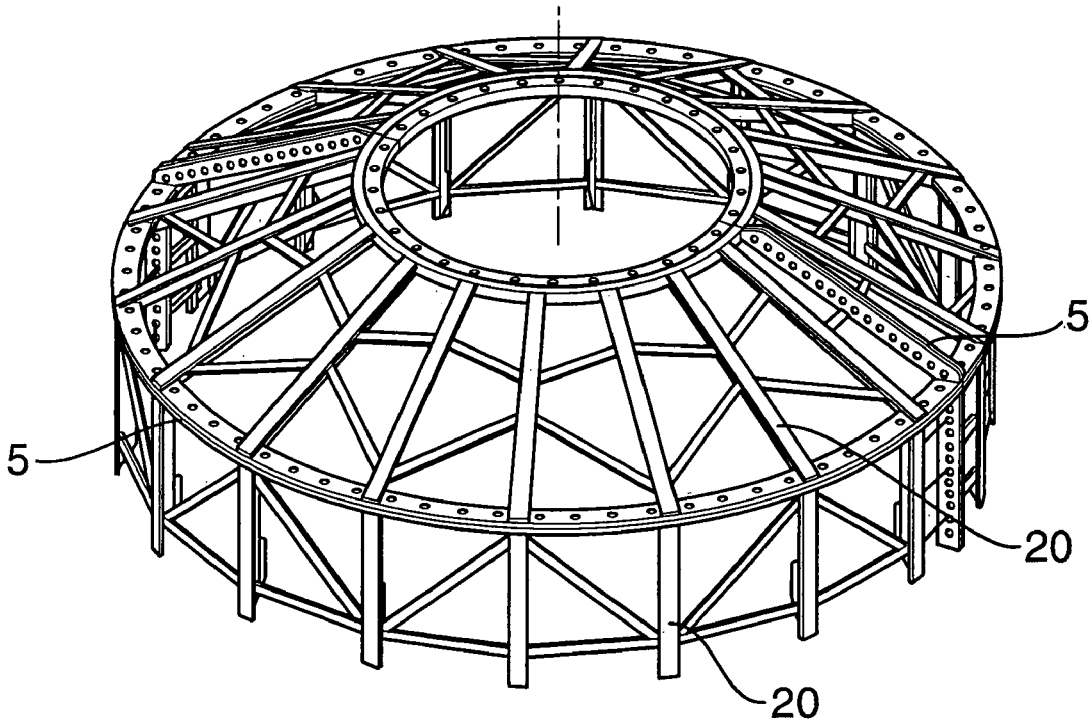
Figure 8:
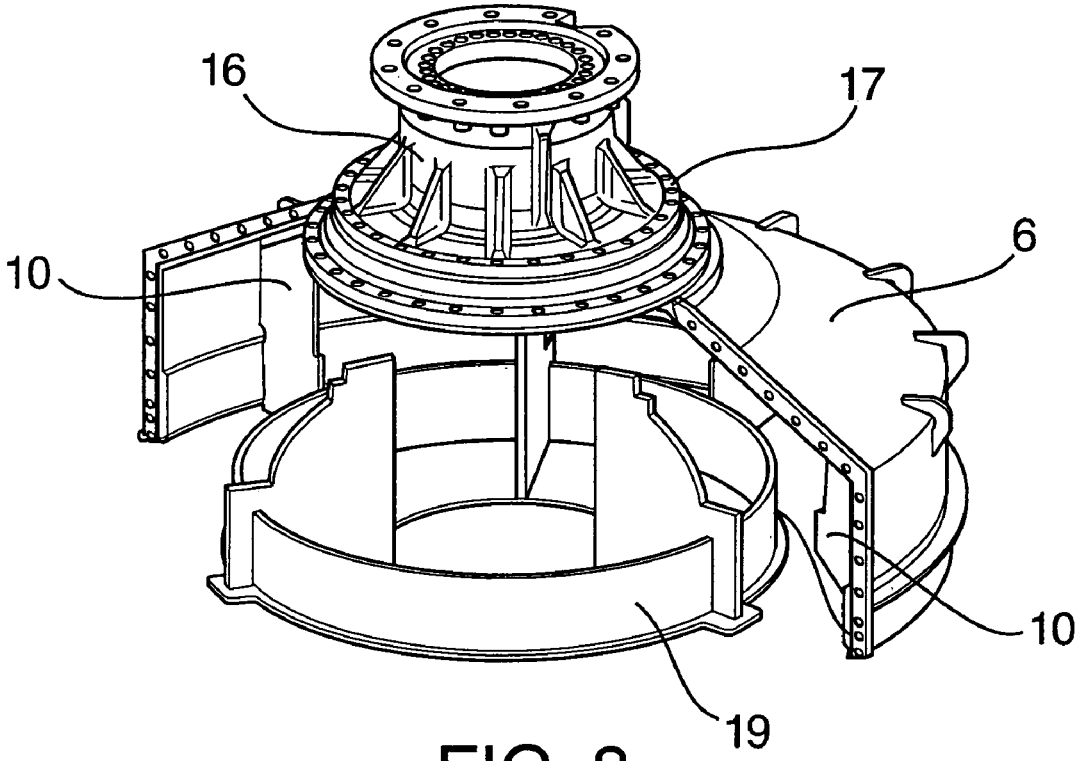
Figure 9:
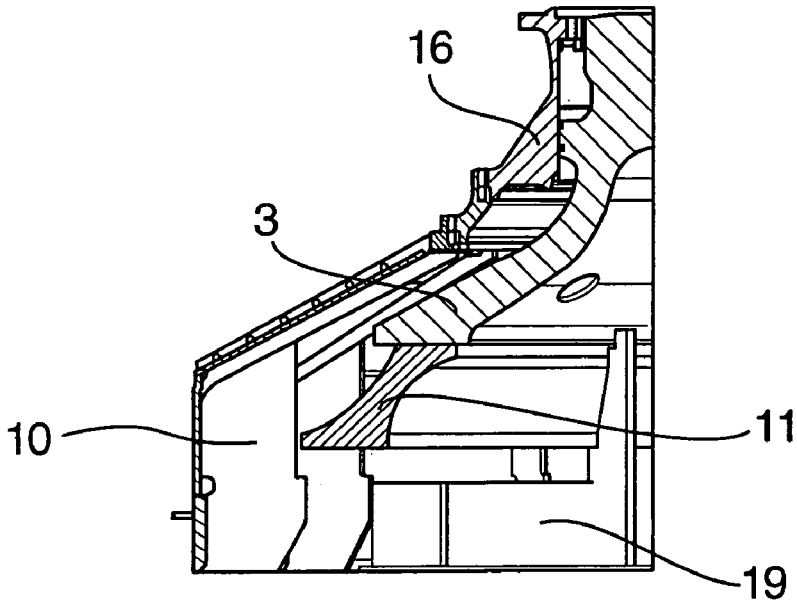
Figure 10:
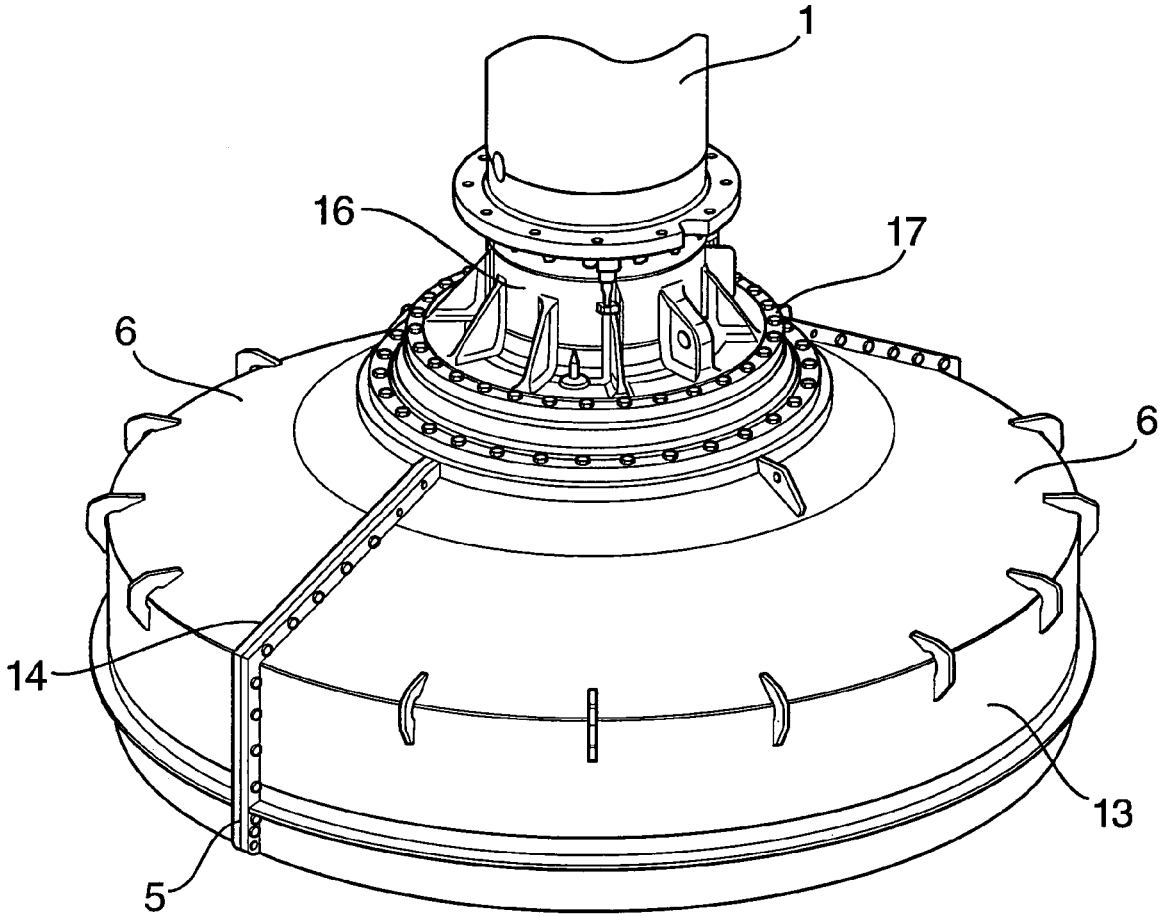

FIG. 3*a* shows a side view of the pile sleeve;

FIG. 3*b* shows a plan view of the pile sleeve;

FIG. 4 shows a 3-dimensional view of the pile sleeve with a circular concentric partition line;

FIG. 5 shows a 3-dimensional view of another embodiment of the pile sleeve with a circular concentric partition line;

FIG. 6 shows a 3-dimensional view of the pile sleeve with a cylinder as a skeleton frame structure;

FIG. 7 shows a 3-dimensional view of the pile sleeve with a cone and cylinder as skeleton frame structure;

FIG. 8 shows a 3-dimensional view of the assembly block and part of the pile sleeve;

FIG. 9 shows a vertical sectional view of a detail of the lower region of the pile driving device with assembly block in vertical section; and FIG. 10 shows a 3-dimensional view of the lower region of the pile driving device.

DETAILED DESCRIPTION OF THE INVENTION

Figure 1:
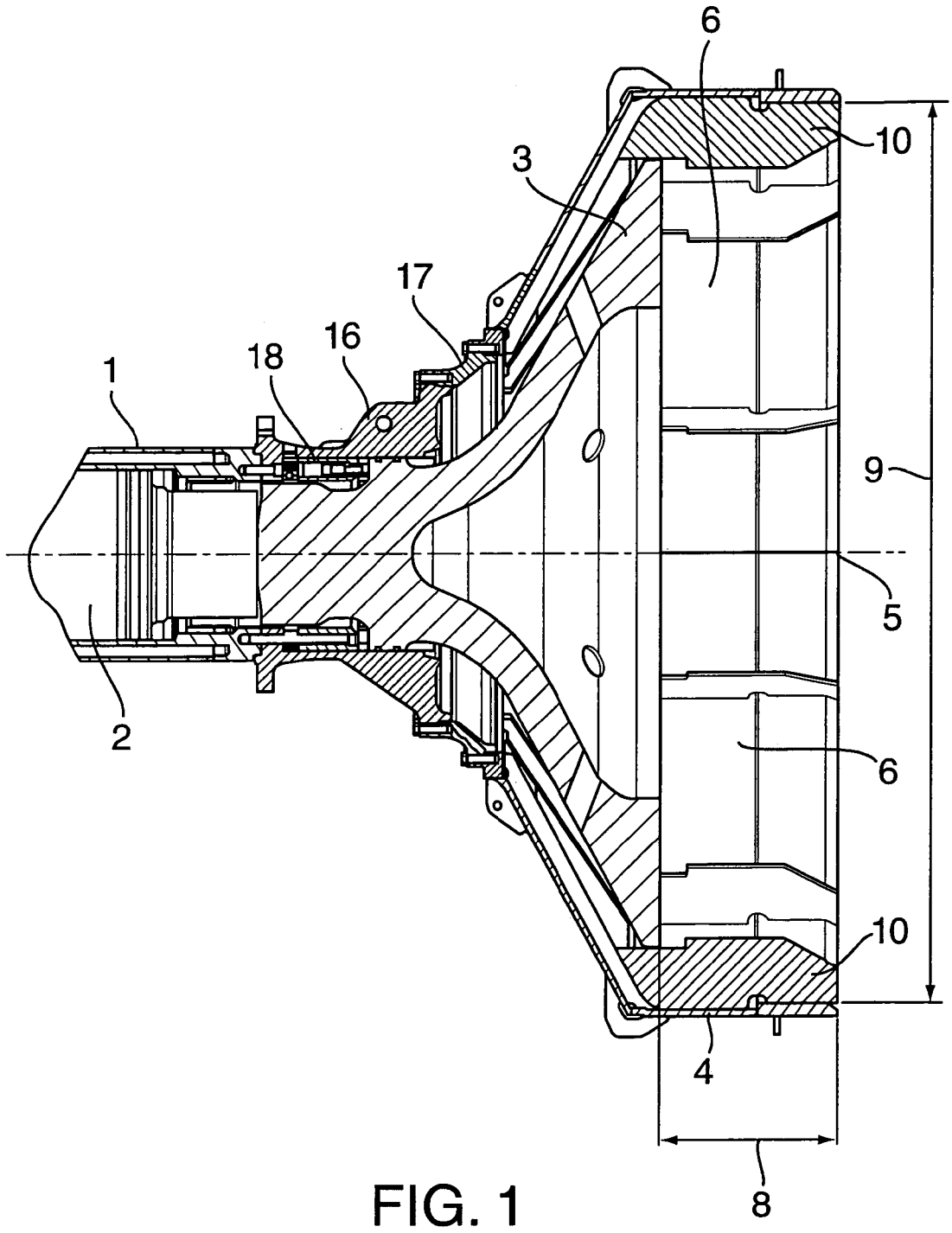
FIG. 1 shows a vertical sectional view through the lower region of the pile-driving device.

FIG. 1 shows a vertical sectional view through the lower region of a substantially rotationally symmetrical pile driving device. The impact body 2 which sits on the impact hood 3 is located in the hammer housing 1. The impact hood 3 is connected to the hammer housing 1 through the hammer foot 16. In the hammer foot 16 are the shock absorbers 18 which absorb the recoil energy. The hammer foot 16 is connected to the pile sleeve 4 through an adapter ring 17. The pile sleeve 4 is divided into a cone 12 which surrounds and covers the impact hood, and a cylinder jacket 13 which forms the actual guide sleeve for the pile (not shown). The pile sleeve 4 has a partition line 5 which divides the pile sleeve 4 into two identical segment parts 6.

The distance 8 between the lower end of the pile sleeve 4 and the impact hood 3 is smaller than half the internal diameter 9 of the pile sleeve 4. This produces an extremely short structural form for the pile sleeve 4.

During operation of the pile driving device the kinetic energy of the impact body 2 is transferred to the impact hood 3 which in turn transfers this to the pile. The pile driving device is guided on the pile radially through the pile sleeve 4. The pile sleeve 4 thereby enables the pile driving device to be securely set on the pile.

Figure 2:
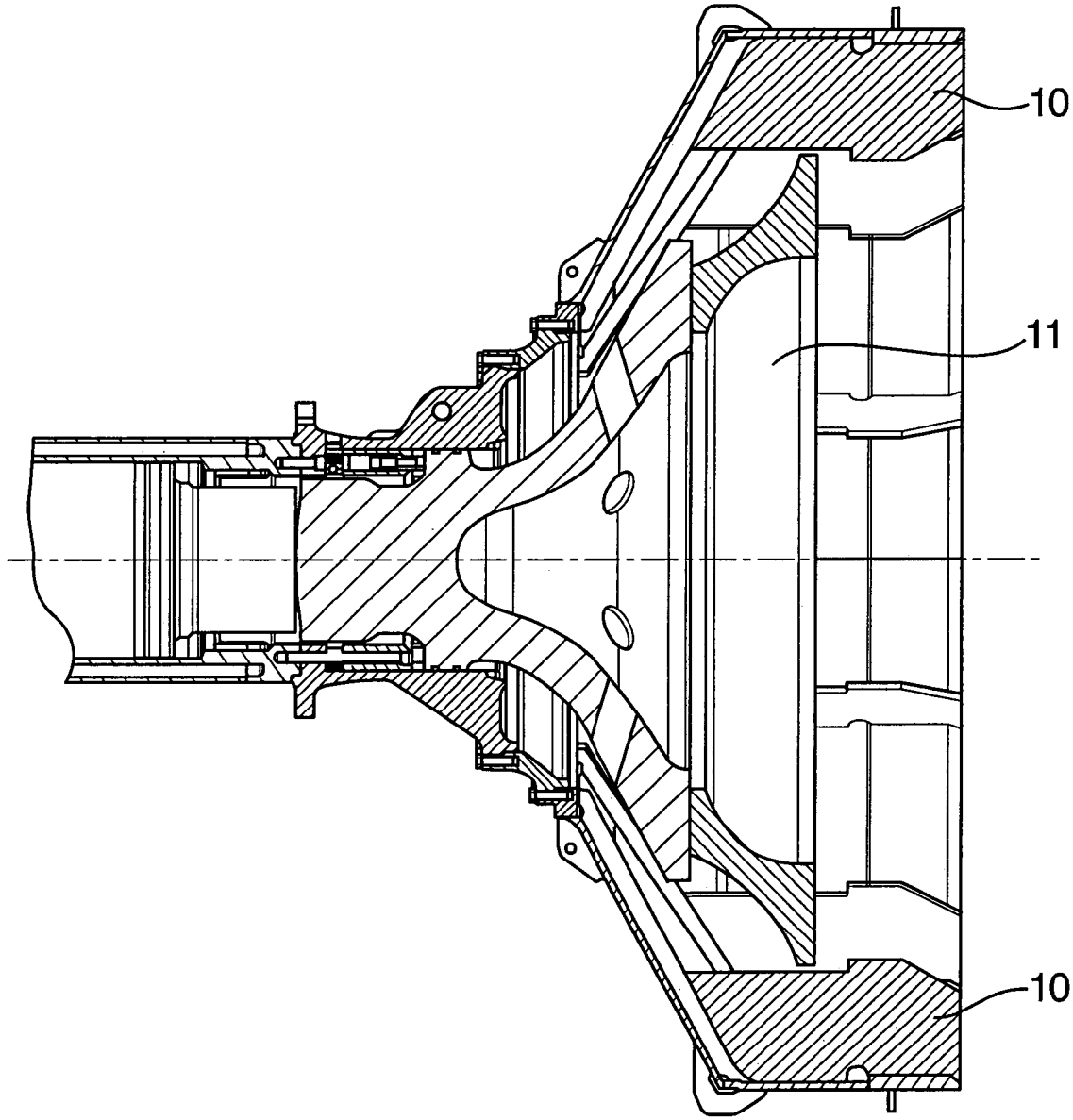
FIG. 2 shows a vertical sectional view through the lower region of another embodiment of the pile driving device.

FIG. 2 shows a different form of the pile driving device in a vertical sectional view. Here an impact hood 3 is used which has an adapter plate 11 at its lower end. This adapter plate is seated on the pile. The impact hood 3 is hereby adapted to the diameter of the pile. Furthermore, radially disposed plates are attached as adapter elements 10 to the pile sleeve 4. The pile sleeve 4 can be adapted to any smaller pile diameter through the adapter elements.

During transport the two parts 6 of the pile sleeve 4 are conveyed separately and are then assembled together at the building site. During assembly the impact hood 3 is initially placed on the assembly block 19. The parts 6 of the pile sleeve 4 are then disposed to surround the assembly block 19 and the impact hood 3 and the flanges 14 of the pile sleeve 4 are then connected together. The hammer foot, impact body and hammer housing are thereby pre-assembled connected as one structural group, preferably including the adapter ring, and are fixedly connected to the impact hood.

The impact hood 3 is thereby already pre-assembled with the hammer foot 16 including the adapter ring 17 connected as one structural group.

FIGS. 3*a* and 3*b* show the divisible pile sleeve 4 in a side view and in plan view in the same embodiment. The pile sleeve 4 consists of a lower part, namely the cylinder sleeve 13 and an upper part, the cone 12, welded thereon. The pile sleeve 4 is divided by the partition line 5 into two parts 6 which are fixedly connected together by means of flanges 14 and screws 15. For underwater work a seal may be provided between the flanges 14 to prevent air from escaping the pile sleeve 4 through the partition line 5.

FIG. 4 shows in a three-dimensional view the pile sleeve 4 in a different embodiment with an additional circular concentric partition line 5. Through this the cone 12 is designed so that it can be divided into an upper part 22 and a lower part 21. Apart from the easier method of transportation there are also advantages during assembly of easier accessibility.

FIG. 5 shows in a three-dimensional view a pile sleeve in which a circular concentric partition line 5 is located between the cone 12 and cylinder jacket 13. The cone 12 can thus be removed completely from the cylinder jacket 13. It is then possible to insert large structural elements, such as the impact hood 3, through the cylinder jacket 13, which is now open at the top, for ease of assembly.

FIG. 6 shows a three-dimensional view of the pile sleeve 4 with cylinder 13 as a skeleton frame structure. The frame structure is formed by connected supports 20. This embodiment can be used on land when an air-tight pile sleeve 4 is not required. Through the method of construction as a skeleton frame structure the pile sleeve 4 has a lighter weight making transport and assembly easier.

FIG. 7 shows a pile sleeve 4 in a 3-dimensional view where both the cone 12 and the cylinder 13 are designed as a skeleton frame structure. A further weight saving is also produced here, increasing the associated advantages for transportation and assembly.

FIG. 8 shows a three-dimensional view of the assembly block 19 set up on a plane and a part 6 of the pile sleeve 4 set up on the plane. The adapter ring 17 with the hammer foot 16 mounted thereon is shown on the part 6. The pile sleeve 4 furthermore has adapter elements 10 which are formed as radially disposed plates. The distance between the cylinder jacket 13 and the pile (not shown) is hereby maintained. The radial assembly furthermore increases the rigidity and stability of the pile sleeve 4. For assembly the impact hood 3 is first placed on an assembly block 19. The parts 6 of the pile sleeve 4 are then arranged around the assembly block 19 and the impact hood 3, i.e. they enclose the impact hood 3. The flanges 14 of the pile sleeve 4 can then be connected together, for example by being screwed together. The hammer foot 16, impact body 2 and hammer housing 1 are pre-assembled and connected into one structural group, preferably including the adapter ring 17. This structural group is fixedly connected on to the impact hood 3 during assembly. Through this method the assembly on site can be carried out particularly quickly and easily.

FIG. 9 shows a vertical section view through a detail of the lower region of the pile driving device with assembly block 19. The adapter plate 11 is fitted on the assembly block 19 which is set up on a plane and the impact hood 3 is then fitted on. Through the adapter plate 11 it is possible to adapt the pile driving device to piles of different diameter since the diameter of the lower face of the adapter plate 11 corresponds to the diameter of the pile which is to be driven in. The impact hoods can hereby be operated in a simple and cost effective manner for a range of pile diameters.

FIG. 10 shows a three dimensional view through the lower region of the pile driving device with a divisible pile sleeve 4, consisting of a cylinder jacket 13 and a cone 12 and a partition line 5. The two parts 6 which are formed by the division line 5 are connected by means of two flanges 14 and screws 15. The pile sleeve 4 is mounted by the adapter ring 17 on the hammer foot 16 which is fixed on the hammer housing 1.

In this way a pile driving device is provided which is surprisingly simple and cost-effective to transport and assemble.

The invention claimed is:

1. A pile driving device for driving in piles, comprising an axially-guided impact body movable in a hammer housing, an impact hood and a pile sleeve wherein the separation between the lower end of the pile sleeve and the impact hood is less than twice the internal diameter of the pile sleeve, and wherein the lower end of the pile sleeve has a diameter of more than 2.5 meters.

2. A pile driving device according to claim 1, wherein the separation between the lower end of the pile sleeve and the impact hood is less than half the internal diameter of the pile sleeve.

3. A pile driving device according to claim 1 wherein the pile sleeve is designed to be divided into two or more parts along at least one partition line.

4. A pile driving device according to claim 3 wherein the partition line is substantially radial.

5. A pile driving device according to claim 3 wherein the partition line is substantially circularly concentric.

6. A pile driving device according to claim 1 wherein the pile sleeve comprises two or more parts and a seal between the parts.

7. A pile driving device according to claim 1, wherein the lower end of the pile sleeve has a diameter of less than 8 meters.

8. A pile driving device according to claim 7, wherein the lower end of the pile sleeve has a diameter of substantially 5 meters.

9. A pile driving device according to claim 1 wherein the pile sleeve further comprises one or more adapter elements for adapting to piles of different diameter.

10. A pile driving device according to claim 9 wherein the adapter elements of the pile sleeve comprise radially disposed plates.

11. A pile driving device according to claim 1 wherein the impact hood further comprises an adapter plate at its lower end, for engagement, in use, with a pile to be driven.

12. A pile driving device according to claim 1 wherein the pile sleeve comprises a cone with a cylindrical jacket.

13. A pile driving device according to claim 12 wherein the cone and/or cylindrical jacket of the pile sleeve comprise a plurality of interconnected supports.

14. A pile driving device according to claim 1 wherein the parts of the pile sleeve have at the or each partition line flanges by means of which they are connected through mechanical connectors.

15. A pile driving device according to claim 1 wherein the hammer housing of the pile driving device comprises a hammer foot and an adapter ring is mounted between the hammer foot and the pile sleeve.

* * * * *